United States Patent [19]

Dugan

[11] Patent Number: 4,648,252

[45] Date of Patent: Mar. 10, 1987

[54] SLIDING DOOR LOCK

[76] Inventor: Thomas J. Dugan, 226 Paseo de Cristobal, San Clemente, Calif. 92672

[21] Appl. No.: 730,191

[22] Filed: May 3, 1985

[51] Int. Cl.[4] ..... E05B 65/08

[52] U.S. Cl. ..... 70/100; 70/157; 70/367; 292/DIG. 46

[58] Field of Search ..... 70/367, 368, 369, 100, 70/370, 371, 382, 385, 95–99, 135, 137, 139; 292/DIG. 20, DIG. 46, DIG. 47

[56] References Cited

U.S. PATENT DOCUMENTS

| | | | |
|---|---|---|---|
| 3,324,693 | 6/1967 | Check | 70/369 |
| 3,431,754 | 3/1969 | Brumelle | 70/371 |
| 4,378,684 | 4/1983 | Dugan | 70/100 |

*Primary Examiner*—Robert L. Wolfe

*Attorney, Agent, or Firm*—Boniard I. Brown

[57] ABSTRACT

A readily rekeyable door lock, particularly for sliding glass patio doors and the like, has a housing to be secured to the door and containing a lock catch rotatable between locking and unlocking positions by a key operated lock unit which is readily replaceable to rekey the door lock.

4 Claims, 5 Drawing Figures

SLIDING DOOR LOCK

BACKGROUND OF THE INVENTION

1. Field of the Invention

This invention relates generally to locks and more particularly to improvements in sliding door locks of the general class described in my prior U.S. Pat. No. 4,378,684.

2. Prior Art

My prior U.S. Pat. No. 4,378,684 discloses a door lock for sliding doors, particularly sliding glass doors of the kind commonly called sliding patio doors. This particular door lock has a housing secured to one side of the door adjacent the front edge of the door, that is the vertical door edge which seats against the door jamb when the door is closed. Entering the rear side of this housing which seats against the door is a cavity that opens laterally toward the front edge of the door, and hence the door jamb, through side apertures in the housing. A passage extends through the housing from its front side into the cavity.

Positioned within this passage is a key lock unit having an outer barrel swaged or otherwise permanently fixed within the passage against both rotation in and axial removal from the passage, and a lock cylinder rotatable within the barrel by a key insertable into a key slot in the front end of the cylinder. This key slot is exposed through the front end of the lock housing passage. A lock catch positioned within the rear housing cavity and extending therefrom through a side aperture in the housing is coupled to the lock cylinder for rotation with the cylinder.

The lock catch has a circular locking tang concentric with the lock cylinder and is rotatable with the cylinder between locking and unlocking positions. In its locking position, the locking tang is extended relative to the lock housing to engage in locking relation, when the door is closed, a lock strike fixed to the door jamb so as to lock the door in its closed position. In its unlocking position, the lock tang is retracted relative to the lock housing to disengage the lock strike and thereby release the door for opening. This locking extension and unlocking retraction of the lock catch occurs with a rotary motion about the axis of the lock cylinder.

My patented lock has many attractive features which adapt the lock to a variety of applications. The lock, however, lacks one feature which is particularly useful in many application. This absent feature is the ability to "rekey" the lock, that is the ability to change the key required to operate the lock. Inability to rekey the lock results from the fact that the key lock unit is permanently fixed within the lock housing.

SUMMARY OF THE INVENTION

This invention provides an improved door lock of the class described which is readily rekeyable, that is the lock may be readily modified to change the key required to operate the lock. The improved lock has a lock housing with front and rear sides, means for securing the lock housing to a sliding door with the rear housing side seating against the door, a cavity entering the rear side of the housing and opening laterally of the housing through aperture means in the housing, and a passage extending through the housing from its front side into the rear cavity. Removably positioned within this passage is a key lock unit which is insertable into and removable from the passage, only through the rear open side and rear cavity of the housing and the rear end of the housing passage. The key lock unit is thus replaceable to "rekey" the lock; that is one lock unit may be readily replaced by another requiring a different key for operation of the lock.

Within the rear cavity of the lock housing is a lock catch which is removably secured to the inner cylinder of the key lock unit. This catch is rotatable with the lock cylinder between locking and unlocking positions. In locking position, the catch extends through the lock housing aperture means for locking engagement with a lock strike to lock the door in closed position. In unlocking position, the catch is retracted to disengage the strike and release the door for opening. According to a feature of the invention, the lock may be designed to accommodate key lock units with differing numbers of lock pins.

DESCRIPTION OF THE PREFERRED EMBODIMENT

Figure 1:
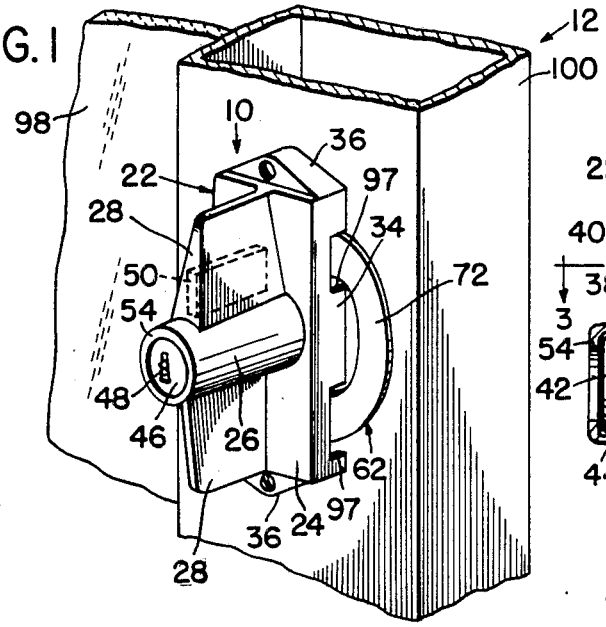
FIG. 1 is a fragmentary perspective view of a sliding door mounting an improved lock according to the invention.

Turning now to the drawings, there is illustrated an improved door lock 10 according to the invention mounted on a sliding door 12, such as a sliding glass patio door, for locking the door in closed position. In this closed position, the front edge of the door projects into a recess 14 in an extruded channel member 16 fixed to the adjacent door jamb 18. Mounted on this channel member, along one side of the recess 14, is a lock strike 20 which cooperates with the lock 10 to lock the door closed, as explained later.

Door lock 10 has a housing 22 which may be cast from metal or otherwise fabricated. While the shape of the housing is essentially arbitrary, the particular shape illustrated is preferred and is generally similar to the shape of the lock housing in my prior U.S. Pat. No. 4,378,684. The illustrated housing has a rear, generally flat rectangular base portion 24, a tubular portion 26 integrally joined to the center of the base portion and extending forwardly therefrom with its axis generally perpendicular to the base portion, and diametrically opposed wing-like ribs 28 joined to the base portion 24 and tubular portion 26. These ribs are disposed in a plane containing the longitudinal centerline of the base portion 24 and the axis of the tubular portion 26.

Entering the rear side of the housing base portion 24 is a cavity 30 which opens rearwardly through the rear side of the housing. This cavity is bounded by the front wall 32 and edge walls 34, 36 of the base portion. These edge walls are located along the perimeter of the base front wall 32 and project rearwardly therefrom. Extending axially through the tubular portion 26 of the housing 22 is a cylindrical passage 38 which opens rearwardly into the housing cavity 30 and forwardly through the front end of the tubular portion. Extending radially upward (as viewed in FIG. 4) from the passage 38 into the upper housing rib 28 and opening rearwardly into the housing cavity 30 is a slot 40.

Removably positioned within the housing passage 38 is a replaceable keylock unit 42. This keylock unit is conventional and hence need not be described in elaborate detail. Suffice it to say that the lock unit has an outer cylindrical barrel 44 containing an inner rotatable lock cylinder 46. Entering the front end of this lock cylinder is a key slot 48 (FIG. 1). Rotation of the lock cylinder 46 relative to the lock barrel 44 is normally prevented by spring loaded lock pins (not shown) mounted within an upper wing-like radial enlargement 50 on the lock barrel 44. When the proper key is inserted into the key slot 48, these lock pins are retracted upwardly into the housing enlargement 50 to free the lock cylinder 46 for rotation by the key. Fixed to and extending rearwardly from the lock cylinder 46 along its central axis is a shaft 52 of generally rectangular cross-section.

Figure 2:
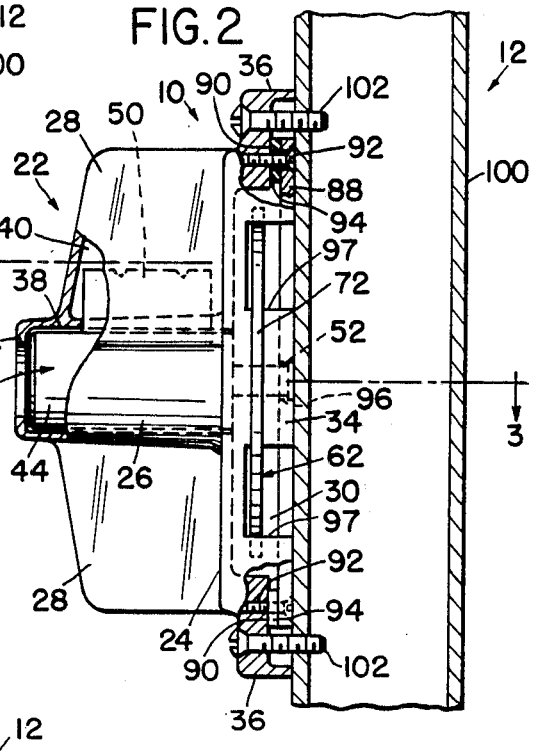
FIG. 2 is an enlarged view taken edgewise of the door in FIG. 1 with the lock partially broken away.

The lock housing passage 38 and slot 40 are sized to slidably receive the lock unit 42 with the lock barrel 44 positioned within the passage 38 and the barrel enlargement 50 positioned within the slot 40. The lock unit is insertable into the lock housing through the rear open side of the housing and the rear end of the passage 38, slot 40. When the lock unit 42 is fully assembled within the lock housing 22, the front end of the lock barrel 44 seats against an inwardly projecting flange or shoulder 54 about the front end of the lock housing passage 38. The barrel enlargement 50 projects into the housing slot 40 and seats against the front wall of this slot, as shown in FIG. 2. From the description to this point, it is evident that the keylock unit 42 is readily removable from the lock housing 22 but only through the rear open side of the housing.

When the lock unit 42 is installed in the lock housing 22, the rear shaft or stem 52 of the lock cylinder 46 projects into the housing cavity 30. Slidably positioned on this stem are a spacer washer 56, a cam disc 58, a drive disc 60, and a lock catch 62. The washer 56, cam disc 58, and drive disc 60 have central rectangular openings 64 slidably receiving the lock stem 52. Accordingly, these elements rotate with the lock cylinder 46. The lock catch 62 has a hub portion 66 containing a central circular opening 68 sized to rotatably receive the lock cylinder stem 52, a generally radial arm portion 70 extending from the hub portion, and a locking tang 72 extending from the outer end of the arm portion 70. This tang is circularly curved about the axis of the catch opening 68 and is slightly longitudinally tapered, as shown.

Figure 3:
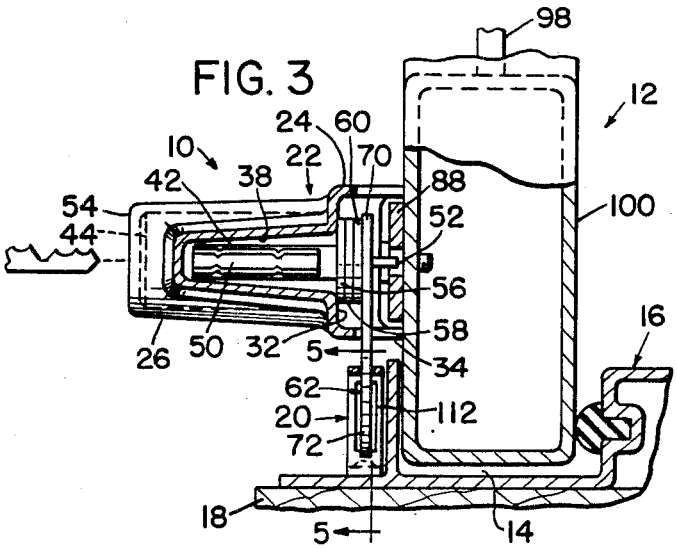
FIG. 3 is a section taken on line 3—3 in FIG. 2.
Figure 4:
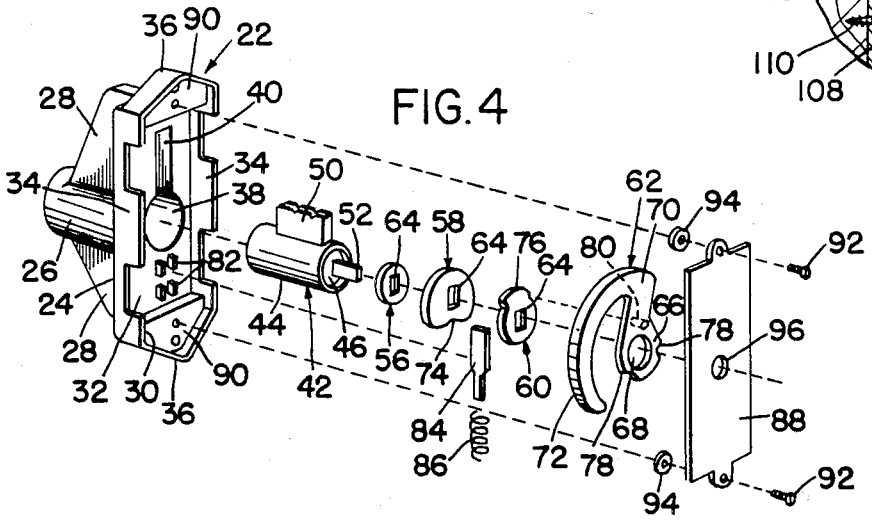
FIG. 4 is an exploded perspective view of the lock.

Cam disc 58 has a concentric circular edge indented at one portion to form a cam recess 74. Drive disc 60 has a concentric circular edge with a radially projecting drive lug 76. Lock catch 62 has a pair of oppositely circumferentially facing latch shoulders 78 on the hub of the catch and a drive pin 80 projecting beyond one side of the catch arm portion 70. The washer 56, cam disc 58, drive disc 60, and catch 62 are assembled in that order on the stem 52 of the lock cylinder 46, as shown in FIGS. 3 and 4. The lock catch drive pin 80 projects across the path of rotation of the drive lug 76 on the drive disc 60 so that rotation of this drive disc with the lock cylinder 46 engages the drive lug 76 with the lock catch drive pin 80 to rotate the lock catch 72, as explained below.

Slidably guided by projecting lugs 82 on the rear side of the front wall 32 of the lock housing base portion 24 is a latch member 84. This latch member spans, in their axial direction, the cam disc 58, drive disc 60, and lock catch 62 and is urged edgewise toward the same by its spring 86. As explained below, this spring loaded latch locks the catch 62 against rotation except during rotation of the lock cylinder 46 by the proper key.

The rear cover plate 88 is shaped and sized to fit removably within and close the rear side of the lock housing cavity 30. This cover plate seats against shoulder surfaces 90 within the ends of the rear cavity and is releasably secured to the lock housing 22 by screws 92. Mounted on these screws are washers 94 which position the cover plate flush with the rear side of the lock housing. The cover plate has a clearance opening 96 which receives the rear end of the lock cylinder stem 52.

Opening through one longitudinal edge of the housing base portion 24 and in the lateral direction of the lock housing 22, are a pair of spaced slot-shaped apertures 97. The locking tang 72 of the lock catch 62 extends from the housing cavity 30 through the upper one of these apertures and is rotatable to a locking position wherein the tang projects back into the housing cavity through the other aperture, as will be explained presently.

The lock 10 is secured to one side of the sliding door 12 adjacent its front edge. The particular door shown is a sliding glass patio door having a glass panel 98 mounted in a frame including a front edge frame member 100. The lock housing 22 is secured to the inner side of this frame member by screws 102 with the housing ribs 28 and base portion 24 vertically oriented and the housing apertures 97 opening toward the door jamb 18. As noted earlier, an extrusion 16 secured to this door jamb has a recess 14 which receives the front edge of the door, that is the door frame member 100, when the door occupies its closed position of FIG. 3.

The lock strike 20 is secured to the extrusion 16 along one side of its recess 14. This strike is fabricated from a metal strap or the like and has convergent portions 104 joined at their convergent ends by a flat crown portion 106. Extending outwardly from the opposite, divergent ends of the strike portions 104 in a common plane parallel to the crown portion 106 are mounting tabs 108. These mounting tabs seat against and are secured by screws 110 to the extrusion 16 with the strike disposed in a plane parallel to the sliding door 12. Extending through the convergent strike portions 104 are coplanar slots 112. The lock strike 20 is positioned so that these slots are disposed in the plane of the lock catch 62.

Figure 5:
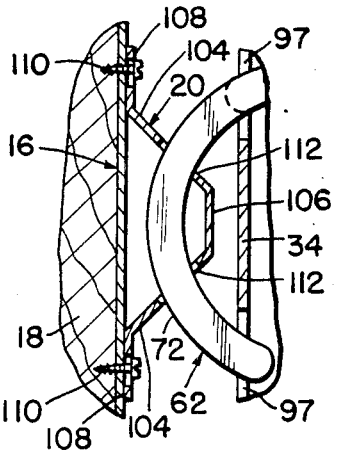
FIG. 5 is a section taken on line 5—5 in FIG. 3.

The lock cylinder 46 is rotatable, to rotate the lock catch 62 between its solid line locking position and broken line unlocking position of FIG. 5, by an appropriate key inserted into the cylinder key slot 48. In its locking position, the locking tang 72 of the lock catch 62 extends from the lock housing 22 through the upper housing aperture 97, then downwardly through the slots 112 in the lock strike 20, and finally back into the lock housing through the lower housing aperture 97. The door 12 is thereby locked in its closed position of FIG. 3. In its unlocking position, the locking tang is retracted upwardly from engagement with the lock strike to release the door for opening.

The spring loaded latch 84 of the lock is conventional and hence need not be explained in elaborate detail. Suffice it to say that when the lock parts occupy their locking positions, the latch 84 engages in the recess 74 of the cam disc 58 and is disposed in the path of one shoulder 78 of the lock catch 62 to restrain the catch against rotation from its locking position. Rotation of the lock cylinder 46 in the clockwise direction in FIG. 4 by its key first rotates the cam disc 58 (and the drive disc 60) to cam the latch 84 downwardly to clear the latch shoulder 78 of the lock catch 62 and thereby release the latter from rotation from its locking position. Continued rotation of the lock cylinder 46 rotates the drive disc 60 (and the cam disc 58) to engage the drive disc lug 76 with the lock catch drive pin 80 and thereby rotate the lock catch 62 from its locking position to its unlocking position. Counter clockwise rotation of the lock cylinder 46 returns the lock catch to its locking position and permits spring return of the latch 84 to its latching position.

As noted earlier, a primary feature of the invention resides in the "re-keyability" of the door lock 10, that is the ability of the door lock to be modified to require a different key for operating the lock. Re-keying of the lock is simply accomplished by removing the lock from the door 12, removing the rear cover plate 88 from the lock housing 22, and retracting the lock unit 42 from the passage 38 in the lock housing. The washer 56, cam disc 58, drive disc 60, and lock catch 62 are removed with the lock unit 42 and are then removed from the rear cylinder stem 52 of the unit. A different lock unit 42 is then installed in the lock housing 22 and the washer 56, cam disc 58, drive disc 60, and lock catch 62 are assembled on the stem 52 of the new lock unit. The lock is then reinstalled on the door 12.

The lock may be designed to receive replaceable lock units with differing numbers of locking pins. The particular lock unit 42 shown, for example, is a five pin unit which requires the spacer washer 56 to occupy the full length of the lock housing passage 38. By eliminating the spacer washer 56, the lock is adapted to receive a six pin lock unit 42. The lock may be arranged, of course, to receive the lock unit with any number of locking pins. In addition to housing the locking pins of the lock unit, the radial wing 50 on the lock barrel 44 fits within the lock housing slot 40 to both key the lock unit against rotation relative to the housing and restrain the lock unit against axial removal through the front end of the housing.

The inventor claims:

1. A lock for securing a door in closed position relative to a door jamb, comprising:

a lock housing having front and rear sides, a cavity entering the rear side of the housing and bounded about its perimeter by an edge wall of said housing having a rear edge disposed in a rear plane of the housing, an opening extending through said housing from said front side into said cavity on an axis substantially normal to said plane, and means for securing said housing to the door with the rear housing side toward the door, a readily replaceable key lock unit contained within said housing opening for removal from and insertion into the opening only through said cavity and the rear end of said opening, said lock unit including an outer barrel fixed against rotation relative to said housing, and an inner cylinder having front and rear ends and rotatable in said barrel about said axis by a key inserted into a key slot in the front end of the cylinder accessible through the front end of said opening, a lock member within and removable through the open rear side of said cavity and projecting from said cavity laterally of said axis through an opening in said housing edge wall, and means releasibly coupling said lock member to the rear end of said lock cylinder for movement of said lock member through said edge wall opening between locking and unlocking positions by rotation of said cylinder with a key inserted into said key slot, and wherein said lock may be re-keyed by removal of said lock unit and lock member from said housing through the rear open side of said cavity, replacement of the lock unit by a different lock unit requiring a different key for operation, and re-assembly of the lock member and new lock unit in the lock housing through the rear side of the housing.

2. The lock of claim 1 wherein:

said means coupling said lock member to said lock cylinder comprises an axial stem extending rearwardly from and rotatable with said cylinder and removably mounting said lock member for rotation of said lock member with said lock cylinder between said locking and unlocking positions, and said housing edge wall opening extends through the rear edge of said edge wall to permit removal and re-assembly of said lock member and lock unit through the rear open side of said cavity.

3. The lock of claim 1 wherein:

said lock member has an aperture non-rotatably receiving said lock cylinder stem and an arcuate locking tang which is circularly curved about said aperture and extends externally of said housing through said housing edge wall opening, and said edge wall opening is a slot opening through the rear edge of said edge wall to permit removal and re-assembly of said lock member and lock unit through the rear open side of said cavity.

4. The lock of claim 1 wherein:

said lock barrel has a radially projecting wing-like rib, and said housing has a slot extending radially from said housing opening and opening rearwardly to said cavity for receiving said rib of said locking barrel when said locking unit is installed in said housing.

* * * * *